US006519988B1

(12) United States Patent
Wu

(10) Patent No.: US 6,519,988 B1
(45) Date of Patent: Feb. 18, 2003

(54) STRUCTURE OF A LOCKSET

(75) Inventor: Ping-Hua Wu, Kaohsiung (TW)

(73) Assignee: One Lus International Co., Ltd., Kaohsiung (TW)

( * ) Notice: Subject to any disclaimer, the term of this patent is extended or adjusted under 35 U.S.C. 154(b) by 0 days.

(21) Appl. No.: 09/935,644

(22) Filed: Aug. 24, 2001

(51) Int. Cl.[7] ..... E05B 27/06
(52) U.S. Cl. ..... 70/358; 78/407; 78/493
(58) Field of Search ..... 70/357, 358, 493, 70/378, 402, 405–407, 409

(56) References Cited

U.S. PATENT DOCUMENTS 4,196,604 A * 4/1980 Vorob ..... 70/358
4,343,166 A * 8/1982 Hofmann ..... 70/358
4,612,787 A * 9/1986 Prunbauer et al. ..... 70/358
4,667,495 A * 5/1987 Girard et al. ..... 70/358 X
5,131,249 A * 7/1992 Baden et al. ..... 70/407 X
5,485,735 A * 1/1996 Laabs et al. ..... 70/358
5,493,884 A * 2/1996 Hinz et al. ..... 70/407
5,533,369 A * 7/1996 Valdajos-Gallego ..... 70/493
5,724,841 A * 3/1998 Botteon ..... 70/493

* cited by examiner

*Primary Examiner*—Suzanne Dino Barrett
(74) *Attorney, Agent, or Firm*—Rosenberg, Klein & Lee

(57) ABSTRACT

A structure of a lockset is disclosed. The lockset structure includes a key and a lock body, wherein the key and the lock hole of the latch are provided with at least one end corner having a skew face with a corresponding angle. Any key with un-matching angle is prevented from inserting into the lock hole so as to avoid other parties to open the lockset with un-matching keys.

1 Claim, 7 Drawing Sheets

STRUCTURE OF A LOCKSET

BACKGROUND OF THE INVENTION (a) Field of the Invention

The present invention relates to a lockset, and in particular, to a lockset including a lock body having a lock body and a key having at least one end corner being a skew face, wherein a lock hole is formed at the latch of the lock body and is corresponding to the skew face.

(b) Description of the Prior Art

As shown in FIG. 1, a conventional lockset comprises a key 1 and a lock 2, and is fitted to a door or the like to prevent unauthorized intruder from entering a locked compartment. The four corners of the key 1 are right angled and are flat structures, and the two sides of the flat structures are provided with a long slot 11 having recesses 12 of various sizes. The lock 2 includes a lock body 21 and a latch 22, and the latch 22 is a cylindrical body for mounting into the cavity hole 211 of the lock body 21. The center of the latch 22 is a lock hole 222 having a similar shape as that of the key 1. The four corners of the lock hole 221 are right angled such that the key 1 can be inserted into the lock hole 221 corresponding to the recesses 12 of the key 1. A plurality of bead holes 212 are provided on the lock body 21. As shown in FIG. 2, at the external of the lock body 21, corresponding to the bead hole 212, a covering plate 213 is provided thereto, and the external of the bead hole 212 is covered. The bead hole 212 is then inserted with a spring 214 and a bead 215, and the bead 215 is cylindrical shape or bead-like. A bead hole 222 is provided to the latch 22, which is corresponding to the bead hole 212. The bead hole 222 reaches the lock hole 221, and a bead 223 is inserted into the bead hole 222. The bead 223 is cylindrical shape or a bead body, and the exterior of the bead 215 is urged by the spring 214. Thus the inner side of the bead 215 is protruded to the bead hole 222 of the latch 22, such that the bead 223 urged by the bead 215 moves to the lock hole 221. As the bead 215 is protruded into the bead hole 212, the latch 22 is blocked by the bead 215 and therefore, the latch 22 is prevented from rotating.

As shown in FIG. 3, if the lockset is to be unlocked, the key 1 is inserted into the lock hole 221. That is the recess 12 of the key 1 pushes the bead 223 and in turn, the bead 215 is pushed out, causing the spring 214 to retract. The retraction of the spring 214 causes the bead 215 to return to the bead hole 212. The latch 22 will not be blocked by the bead 215 and the key 1 can rotate to unlock the lockset. If the key 1 is not matching with the lockset, the spring 214 will be compressed and this causes the bead 223 to protrude into the bead hole 212, or the bead 215 into the bead hole 222. This restricts the latch 22. However, the drawback of the convention structure lockset is that only one precaution is provided by the lockset and if the bead can be kept in alignment with the bead hole, the lockset is unlocked. As a result if the conventional lockset is tampered with a specific device, the lockset can be unlocked. Therefore, it is an object of the present invention to provide a structure of a lockset which mitigates the above drawbacks.

SUMMARY OF THE INVENTION

Accordingly, it is an object of the present invention to provide a structure of a lockset, wherein by means of a key together with a latch formed with a lock hole having at least an end corner being a corresponding skew face, and the skew face of the key is provided with a recess, and the latch and the lock body at the corresponding end corner are provided with pegging beads to enhance the binding force of the rotation of the latch so that the locking effect of the lockset is obtained.

Yet another object of the present invention is to provide a structure of a lockset, wherein the positive face pegging bead interlaced with the skew face pegging bead, and the skew face pegging bead urges the rail wall of the recess to enhance the binding force of the rotation of the latch so that the locking effect of the lockset is obtained.

It is an object of the present invention to provide a structure of a lockset, wherein by means of a key together with a latch formed with a lock hole having at least an end corner being a corresponding skew face, any key with un-matching angle is prevented from inserting into the lock hole so as to avoid other parties to open the lockset with un-matching keys.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
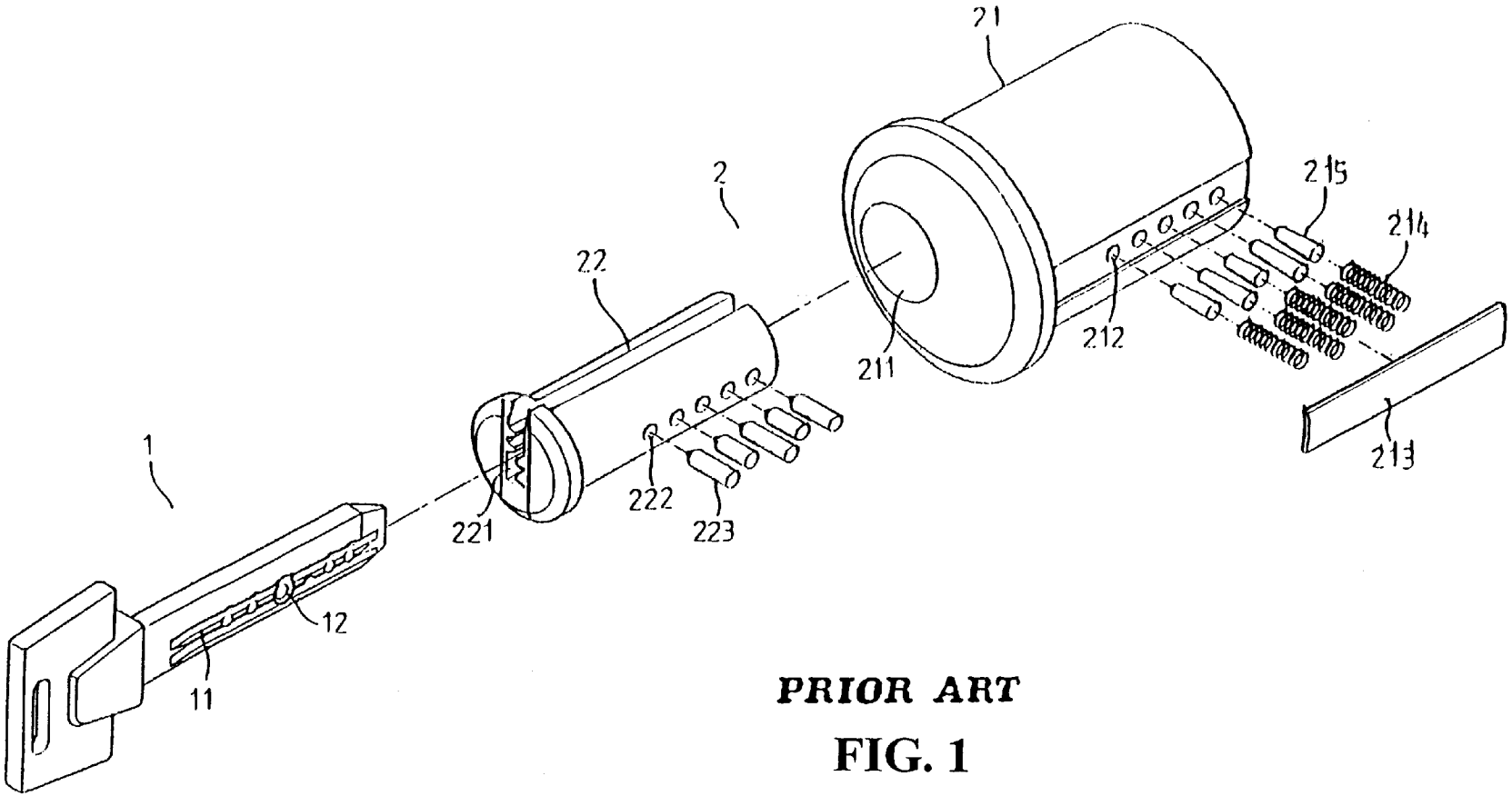
PRIOR ART FIG. 1
FIG. 1 is a perspective view of a conventional lockset.
Figure 2:
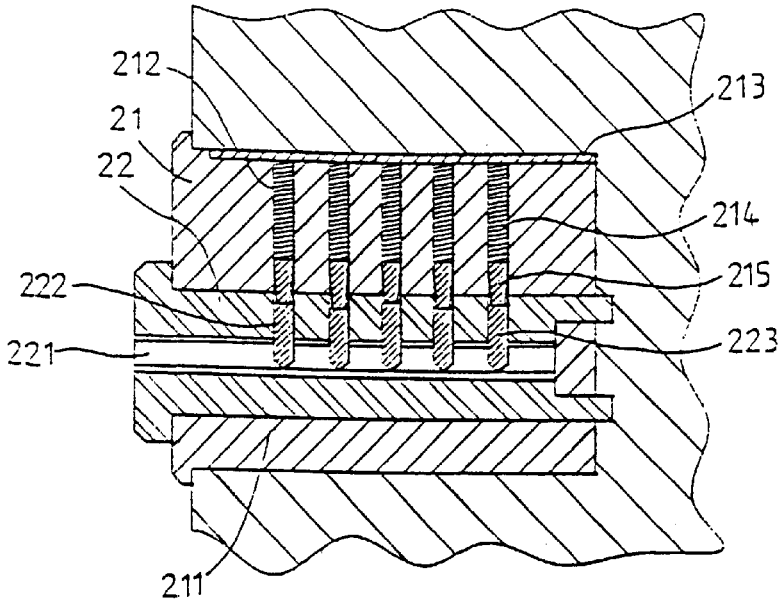
PRIOR ART FIG. 2
FIG. 2 is a sectional view of the conventional lockset.
Figure 3:
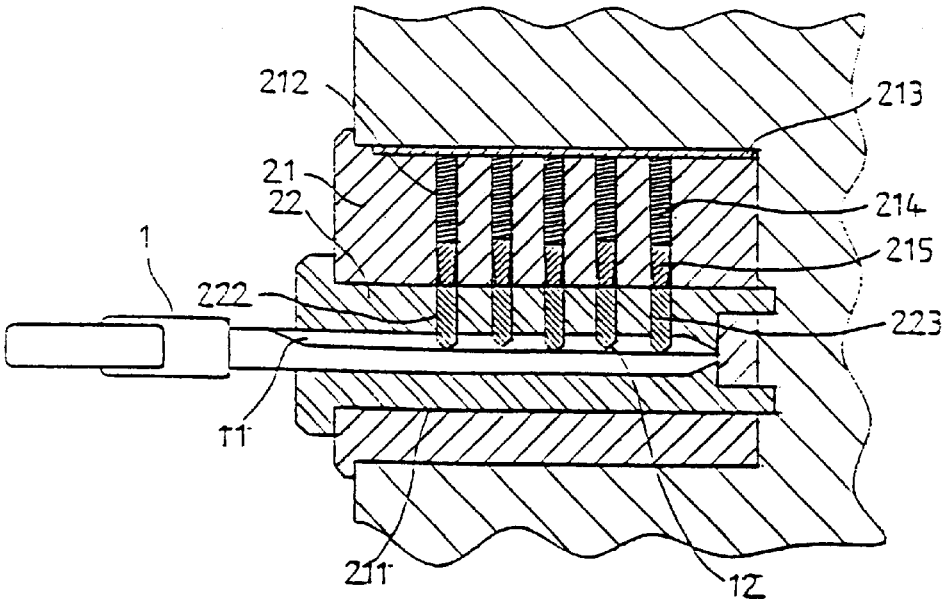
PRIOR ART FIG. 3
FIG. 3 is a sectional view showing the insertion of a key into the conventional lockset.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 4:
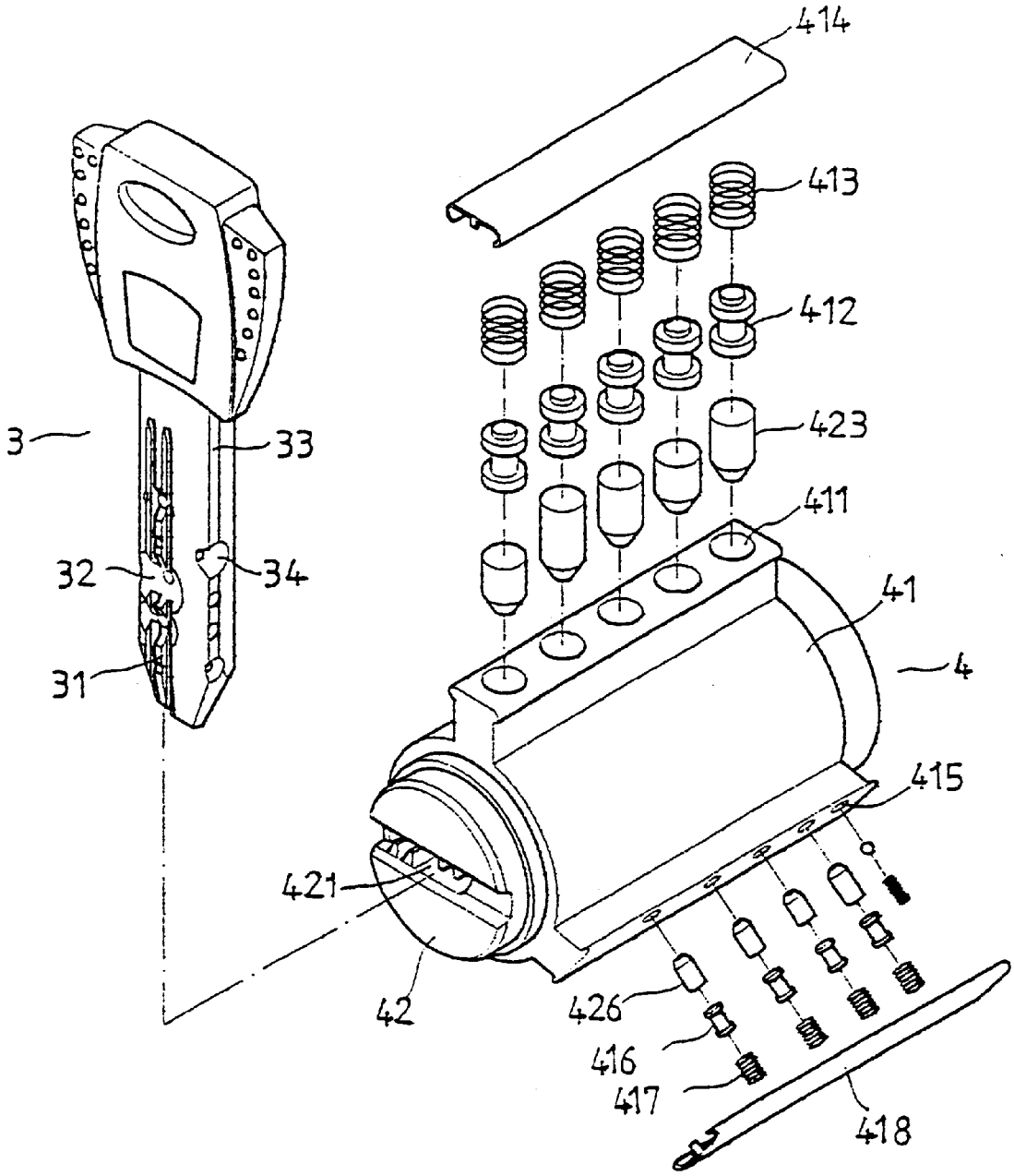
FIG. 4 is a perspective view of a preferred embodiment of the lockset of the present invention.

Referring to FIG. 4, there is shown a lockset comprising a key 3 and a lock 4. The key 3 has a flat shaped structure with two lateral sides. The two lateral sides are provided with a long slot 31 having a plurality of unequally spaced recesses 32. The lock 4 includes a lock body 41 and a latch 42.

Figure 5:
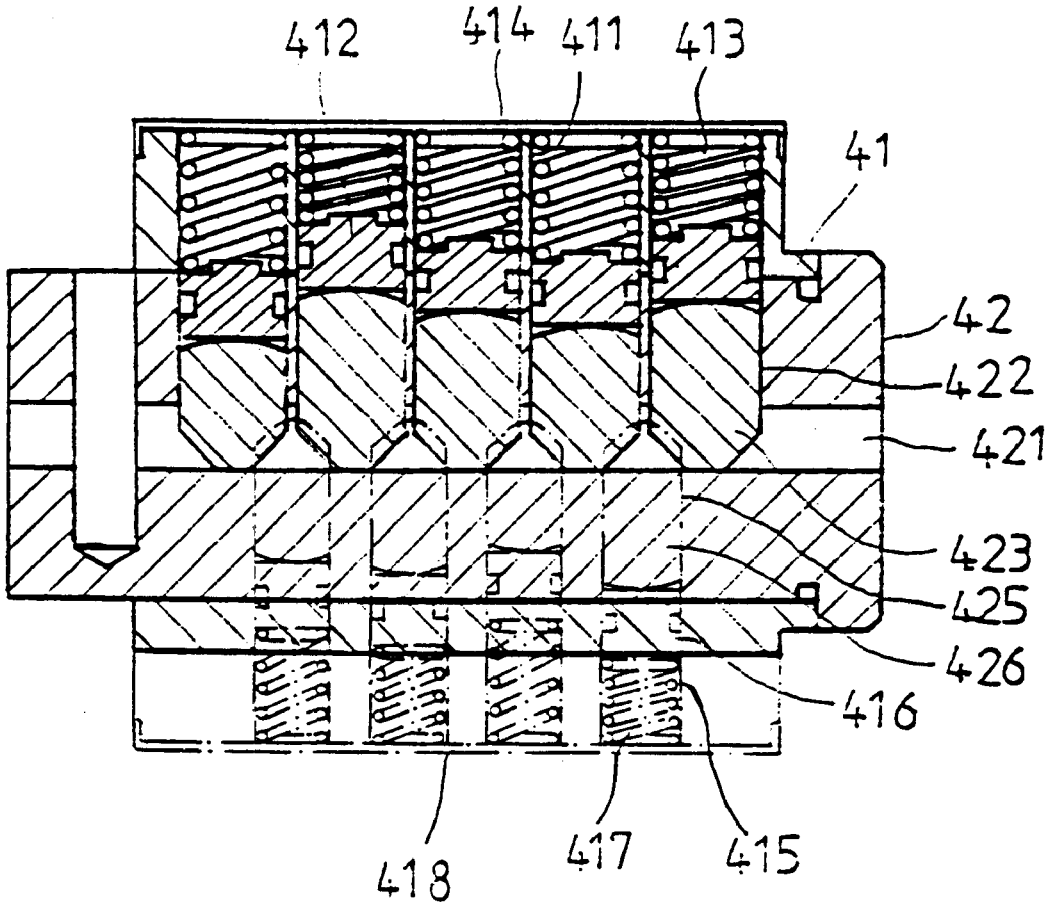
FIG. 5 is a side sectional view of a preferred embodiment of the lockset of the present invention.

The latch 42 is integrally formed with the latch body 41, and the center of the latch 42 is a lock hole 421 corresponding to the shape of the key 3. Referring to FIG. 5, on the circumferential edge of the lock body 41 and corresponding to the recess 32, a plurality of positive bead holes 411, 422 are formed, and the holes 411, 422 reach the lock hole 421. The bead hole 411, 422 are provided with positive face pegging beads 423, 412 and a spring 413, and a covering plate 414 is mounted onto the opening of the positive bead holes 411 such that the positive face bead holes 411 are of a closed plug shape. The beads 423, 413 can be cylindrical shape or bead-like.

Figure 6:
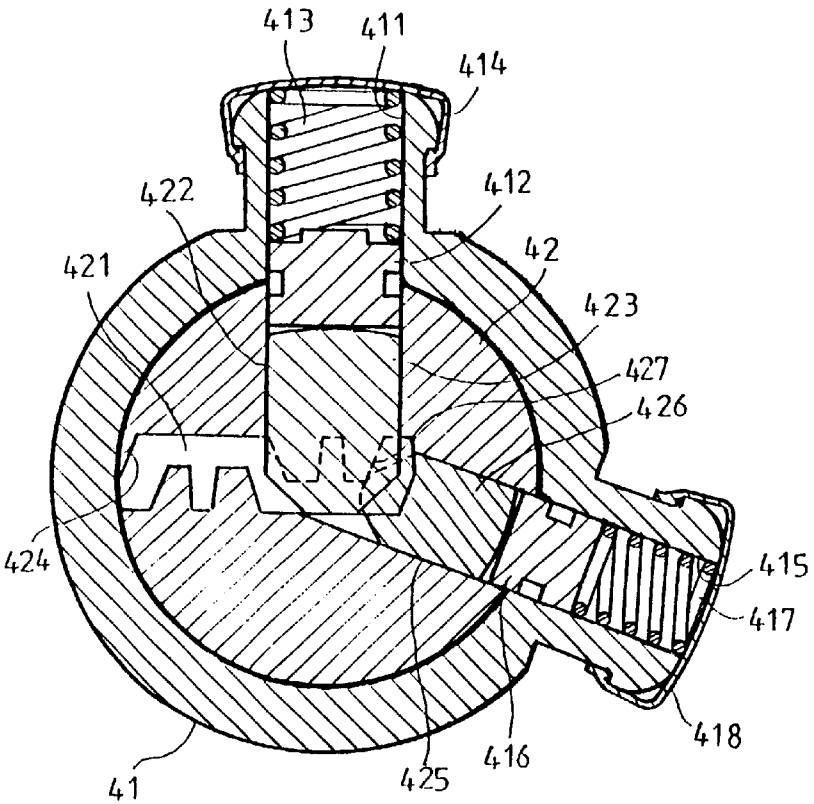
FIG. 6 is a front sectional view of a preferred embodiment of the lockset of the present invention.
Figure 8:
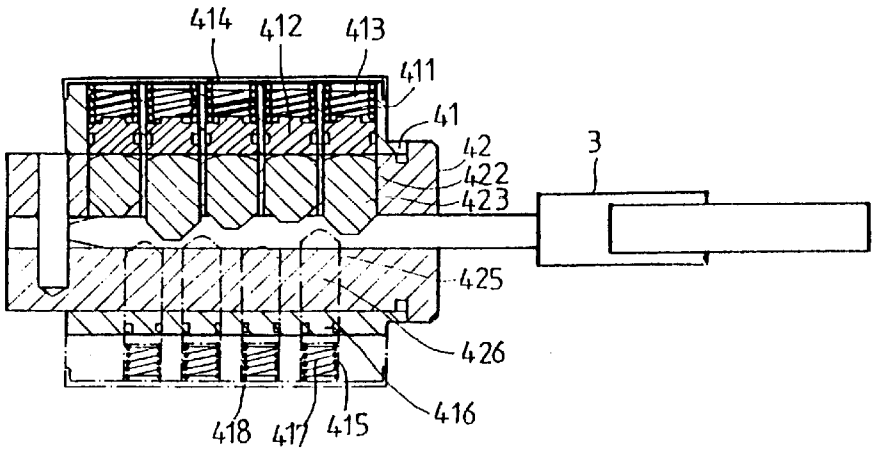
FIG. 8 is a side sectional view, showing the key being inserted into the lock hole in accordance with the present invention.
Figure 10:
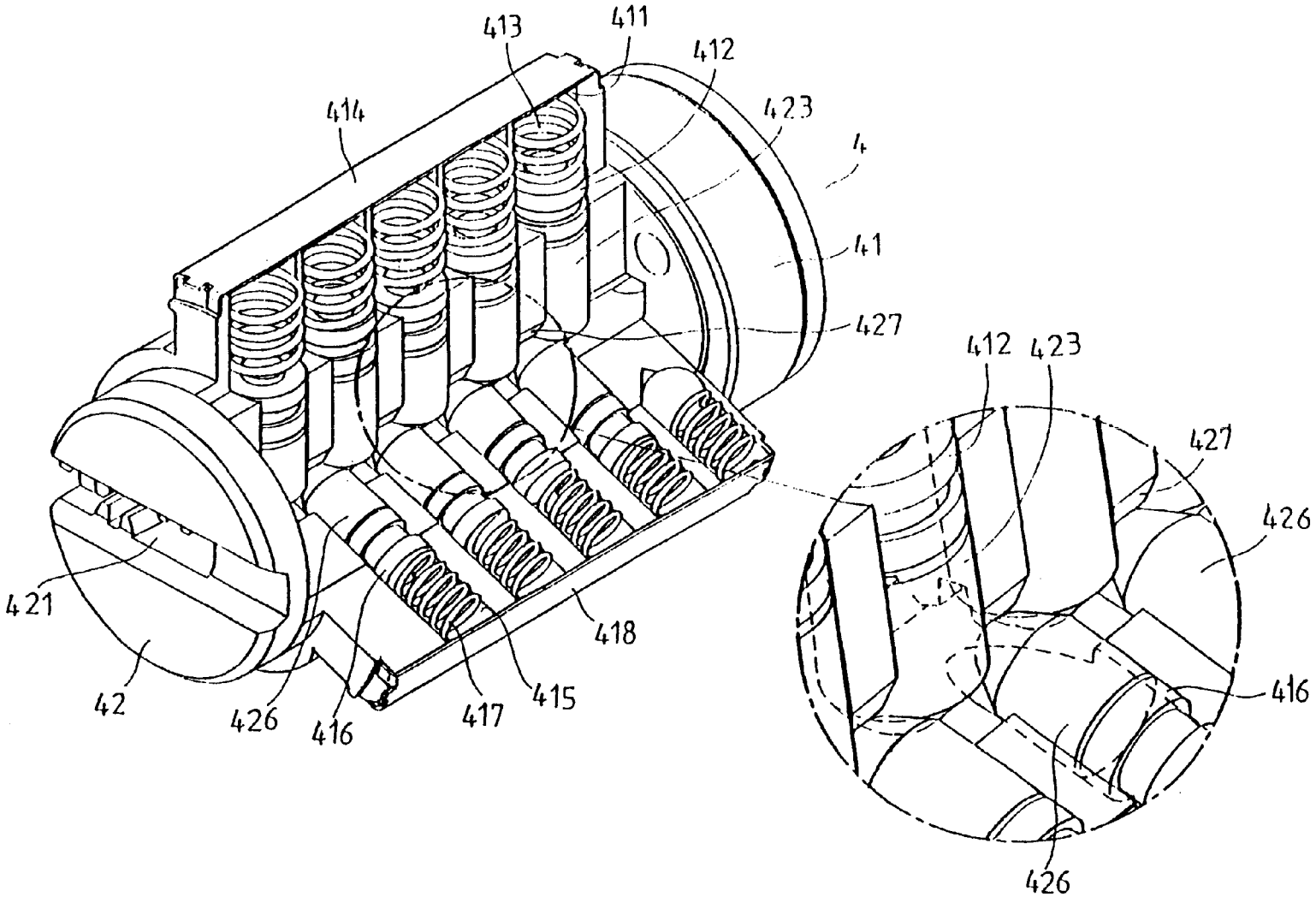
FIG. 10 is a partial sectional view of FIG. 4 of the present invention.

In accordance with the present invention, at least one end corner of the four end corners of the key 3 has a skew face 33 with a certain angle. As shown in FIG. 6, the lock hole 421 of the latch 42 and the end corner corresponding the skew face 33 are provided with a skew face 424. The angle of the skew faces 33, 424 can be changed optionally such that the lockset is provided with different angle. There are sloping recesses 34 provided to the skew face 33 of the key 3, and the recesses 34 are interlaced with the recesses 32 at the flat end of the key 3. As shown in FIG. 8, on the circumferential face of the lock body 41, corresponding to the recess 34 of the key 3, skew bead holes 415, 425 are provided and are through hole till the skew face 424 of the lock hole 421. The skew beads 426, 416 and the springs 417 are provided to the bead holes 415, 425. A covering plate 418 is mounted onto the opening of the bead hole 415, and the outside of the bead hole 415 is covered. The pegging beads 416, 426 are either cylindrical or bead body. Due to the interlaced of the recesses 34 and recesses 32, as shown in FIG. 10, the positive face beads 412, 423 and the skew face beads 416, 426 are interlaced. At the same time, the skew face bead 426 urges the rail wall 427 of the lock hole 421 and positioned.

Figure 7:
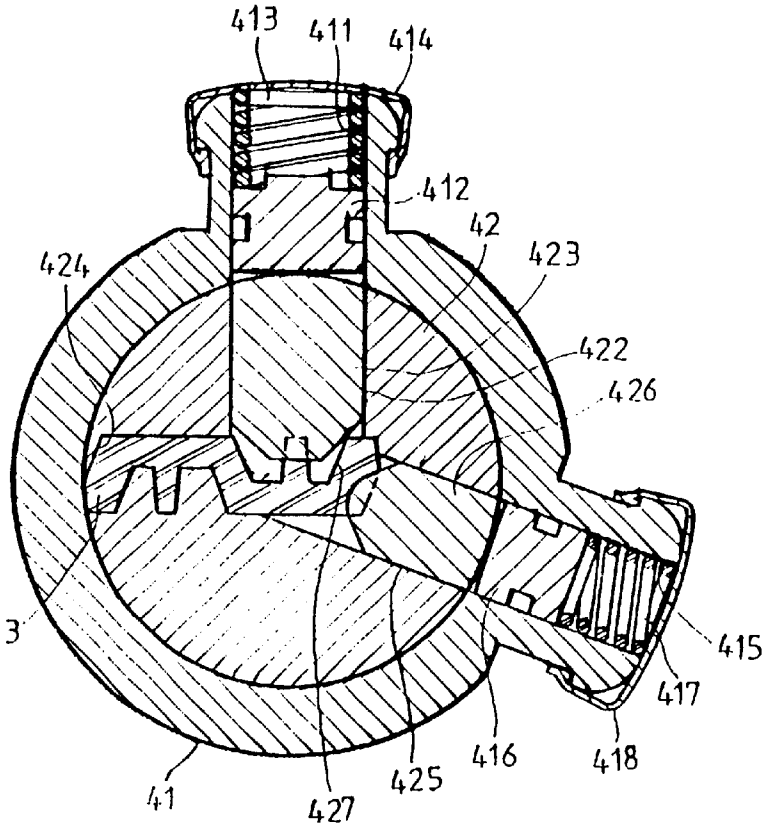
FIG. 7 is a front sectional view showing the key prior to insertion into the lock hole in accordance with the present invention.
Figure 9:
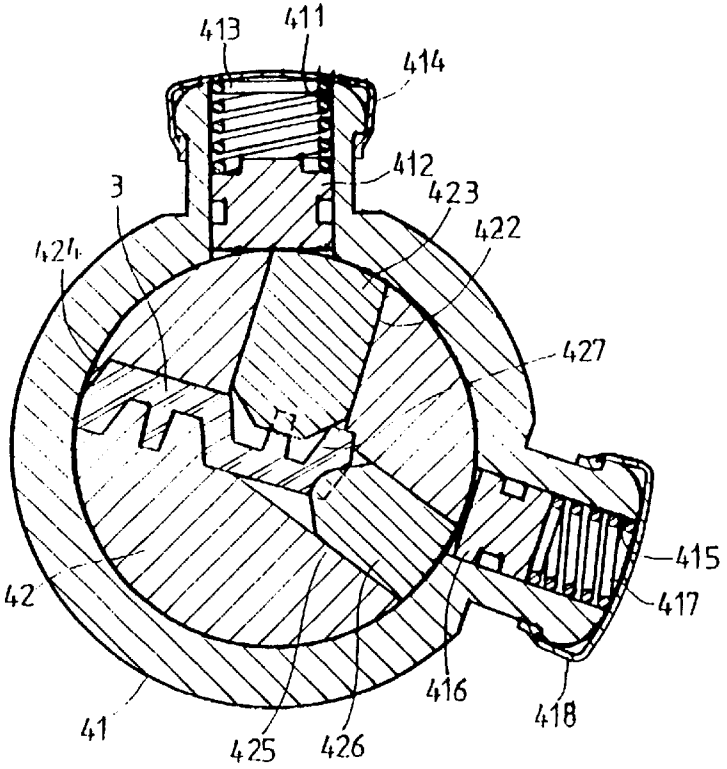
FIG. 9 is a schematic view showing the unlocking of the lockset in accordance with the present invention.

When the lockset is to be unlocked, the key 3 is inserted into the lock hole 421, the skew face 33 of the key 3 is complied with the skew face 424, and the key 3 can be smoothly inserted into the lock hole 421 as shown in FIG. 7. The recess 34 at the skew face 33 causes the skew face bead 426 within the skew face bead hole 425 to move outside, and the pushing force urges the skew face bead 416 to compress the spring 417 to retract. At this instance, the skew face bead 416 and the skew face bead 415 are in alignment. Referring to FIG. 8, the recess 32 urges the positive face bead 423 to move outside so that the bead 423 urges the bead 412 of the lock body 41 to cause the spring 413 to retract. The positive face bead 412 and the positive bead 411 are in alignment. At this instance, the latch 42 does not engage or restrict by the positive face bead 412 and the skew face bead 416. As shown in FIG. 9, if the key 3 is rotated, the latch 42 is driven to rotate and the lockset is unlocked.

If a third party is to unlock the lockset, as there is no skew faces 33, 424 at the key 3, and the end corner of the latch or the angles of the skew faces 33, 424 are not correct, the key 3 cannot be inserted. Thus, the lockset has prevented a third party to insert a wrong key into the lock body. Besides there are recesses 34 provided at the skew face 33 of the key 3, and there are skew face bead 425 is provided to the latch 42, and the lock body 41 is provided with a skew body 416 and the spring 417, and the skew beads 416, 426 are interlaced with the positive face beads 412, 423 and are protruded to urge at the rail wall 427, another resistance is further provided to the latch 42, such that the unlocking of the lockset is further prevented.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lockset structure having a key and a lock, the lock comprising a lock body having a cavity hole for insertion by a latch, the latch being provided with a lock hole for the key, a plurality of positive face beads located in face bead holes formed in the lock body and the latch, the positive face beads being interlaced with a plurality of skew face beads respectively disposed in skew bead holes formed in the lock body and the latch, the skew face beads being extended into the lock hole of the latch and biased against a rail wall of the lock hole.

* * * * *